US011612996B2

(12) United States Patent
Chen

(10) Patent No.: US 11,612,996 B2
(45) Date of Patent: Mar. 28, 2023

(54) CLEANING TOOL

(71) Applicant: JIASHAN MASTER TOP INT'L INC., Jiaxing (CN)

(72) Inventor: Chia-Cheng Chen, Jiaxing (CN)

(73) Assignee: JIASHAN MASTER TOP INT'L INC., Jiaxing (CN)

( * ) Notice: Subject to any disclaimer, the term of this patent is extended or adjusted under 35 U.S.C. 154(b) by 463 days.

(21) Appl. No.: 16/832,984

(22) Filed: Mar. 27, 2020

(65) Prior Publication Data

US 2021/0299847 A1 Sep. 30, 2021

(51) Int. Cl.

| | |
|---|---|
| ***B25G 3/38*** | (2006.01) |
| ***A47L 13/24*** | (2006.01) |
| *A47L 13/42* | (2006.01) |

(52) U.S. Cl.

CPC ..... *B25G 3/38* (2013.01); *A47L 13/24* (2013.01); *A47L 13/42* (2013.01)

(58) Field of Classification Search

CPC ..... A47L 13/20; A47L 13/24; A47L 13/42; B25G 3/38

See application file for complete search history.

(56) References Cited

U.S. PATENT DOCUMENTS 5,983,455 A * 11/1999 Polzin ..... B25G 1/04 15/144.4
2004/0134803 A1* 7/2004 Michelson ..... A47L 13/52 15/257.7

FOREIGN PATENT DOCUMENTS

CA 2694323 A1 * 2/2009 ..... A47L 13/38
CA 3009220 A1 * 12/2019 ..... A46B 5/0045

* cited by examiner

*Primary Examiner* — Shay Karls
(74) *Attorney, Agent, or Firm* — Apex Juris, PLLC; Tracy Heims; R Wylie

(57) ABSTRACT

A cleaning tool including a holding rod and a first tool assembly connected to the holding rod. The holding rod includes a first rod body, a second rod body pivotally connected to the first rod body, and a fixing structure disposed on either the first rod body or the second rod body and having an engaging portion. The other one of the first rod body and the second rod body not disposed with the fixing structure has an engaged portion correspondingly and detachably engaged with the engaging portion. When the engaging portion is engaged with the engaged portion, the first rod body is correspondingly connected to the second rod body to make the holding rod has a maximum length. When the engaging portion is disengaged from the engaged portion, the first rod body and the second rod body is controllably folded to each other, making the cleaning tool has a smaller volume.

10 Claims, 7 Drawing Sheets

CLEANING TOOL

BACKGROUND OF THE INVENTION

Technical Field

The present invention relates generally to a cleaning tool, and more particularly to a cleaning tool having a holding rod which is foldable and could be straightened and be fixed.

Description of Related Art

Most of cleaning tools adapted to clean a high surface and a large area are rod shaped and include a rod integrally formed as a monolithic unit and a tool head, wherein the tool head is mounted to an end of the rod; the user holds another end of the rod of the cleaning tool, thereby to clean up an uncleaned surface by pulling and pushing the rod to bring the tool head to move and clean.

The higher or the larger the uncleaned surface is, the longer the rod body of a rod of the cleaning tool that the user should choose, in order to enhance convenience of clean up and to increase the efficiency of clean up.

However, when the cleaning tool has the rod with the longer rod body, such cleaning tool is inconvenient to be stored, carried, or transported. Besides, the cleaning tool has the longer rod body is much easier to be bent or broken due to a crush.

To sum up, the conventional cleaning tool having the longer rod body still has room for improvement, in order to overcome problems that such cleaning tool is not easy to be stored, carried, or transported and is more easily to be bent or broken due to a crush.

BRIEF SUMMARY OF THE INVENTION

In view of the above, the primary objective of the present invention is to provide a cleaning tool has a holding rod which is straightenable and foldable, in order to overcome the problems that the conventional cleaning tool is not easy to be stored, carried, or transported and is more easily to be bent or broken due to a crush.

The present invention provides a cleaning tool includes a holding rod and a first tool assembly. The holding rod includes a fixing structure, a first rod body, and a second rod body, wherein a first end of the first rod body is pivotally connected to a first end of the second rod body. The fixing structure is disposed on either the first rod body or the second rod body and has an engaging portion, and the other one of the first rod body or the second rod body has an engaged portion. The engaging portion is detachably engaged with the engaged portion correspondingly. When the engaging portion is engaged with the engaged portion, the first end of the first rod body is correspondingly connected to the first end of the second rod body, thereby the holding rod has a maximum length. When the engaging portion is disengaged from the engaged portion, the first rod body and the second rod body is controllably folded to each other. The first tool assembly connected to a second end of the first rod body, wherein the second end of the first rod body is opposite to the first end of the first rod body.

In an embodiment, the fixing structure includes a first pressed portion, the engaging portion, a first resisting portion, and a fulcrum. The first pressed portion and the first resisting portion face opposite directions and are located on a side of the fulcrum, and the engaging portion is located on another side of the fulcrum opposite to the side with the first pressed portion and the first resisting portion. The first resisting portion is connected to a first elastic member. When the engaging portion is correspondingly engaged with the engaged portion, the first resisting portion is resisted by the first elastic member to make the engaging portion abut against the engaged portion, so that the first end of the first rod body is correspondingly connected to the first end of the second rod body, thereby the holding rod has the maximum length. When the first pressed portion is pressed by an external force, the engaging portion is moved in a direction away from the engaged portion to be disengaged from the engaged portion, thereby to make the first rod body and the second rod body be folded to each other.

In an embodiment, the holding rod includes a binding member which is disposed on either the first rod body or the second rod body. When the first rod body and the second rod body are folded to be substantially parallel to each other, the other one of the first rod body and the second rod body, which isn't disposed with the binding member, is detachably connected to the binding member.

In an embodiment, the binding member includes a fixing ring and a C-shaped loop. The fixing ring is connected to the C-shaped loop to be adjacent to the C-shaped loop and is disposed on either the first rod body or the second rod body. When the first rod body and the second rod body are folded to each other to be substantially parallel to each other, the other one of the first rod body and the second rod body, which isn't disposed with the binding member, is detachably connected to the C-shaped loop.

In an embodiment, the C-shaped loop is pivotally connected to the fixing ring and is able to pivot relative to the fixing ring.

In an embodiment, the first tool assembly includes a pivotable member and a fixing member. The pivotable member is pivotally connected to the fixing member which is fixed to the second end of the first rod body of the holding rod.

In an embodiment, either the pivotable member or the fixing member includes a positioning flange, and the other one includes at least one positioning recess. When the positioning flange corresponds to the at least one positioning recess, the positioning flange is engaged with the at least one positioning recess, so that the pivotable member is unable to pivot relative to the fixing member.

In an embodiment, the positioning flange includes a second pressed portion, an abutting portion, and a second resisting portion. The second pressed portion and the abutting portion are located on a side of the positioning flange, and the second resisting portion is located on another side of the positioning flange opposite to the side with the second pressed portion and the abutting portion. The second resisting portion is connected to a second elastic member. When the positioning flange is correspondingly engaged with the at least one positioning recess, the positioning flange is resisted by the second elastic member to make the abutting portion abut against the at least one positioning recess. When the second pressed portion is pressed by an external force, the positioning flange is moved in a direction toward the second elastic member, thereby the abutting portion is disengaged from the at least one positioning recess, allowing the pivotable member to freely pivot relative to the fixing member.

In an embodiment, the first tool assembly includes a pivotal axis, and the pivotable member is connected to the fixing member via the pivotal axis. The at least one positioning recess includes a plurality of positioning recesses arranged around the pivotal axis. When the pivotable member pivots relative to the fixing member to make the positioning flange corresponds to one of the three positioning recesses, the positioning flange is engaged with the corresponding positioning recess.

In an embodiment, an axial direction of the pivotal axis is perpendicular to a longitudinal direction of the holding rod.

In an embodiment, the cleaning tool includes a second tool assembly connected to a second end of the second rod body of the holding rod, wherein the second end of the second rod body is opposite to the first end of the second rod body.

With the holding rod which is straightenable and foldable, a volume of the cleaning tool provided by the present invention could be reduced, which facilitates store, carry, or transport the cleaning tool easily. On the other side, the cleaning tool has the holding rod which is straightenable and foldable, so that the problem that the rod body is bent or is broken due to the crush during transportation could be solved.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
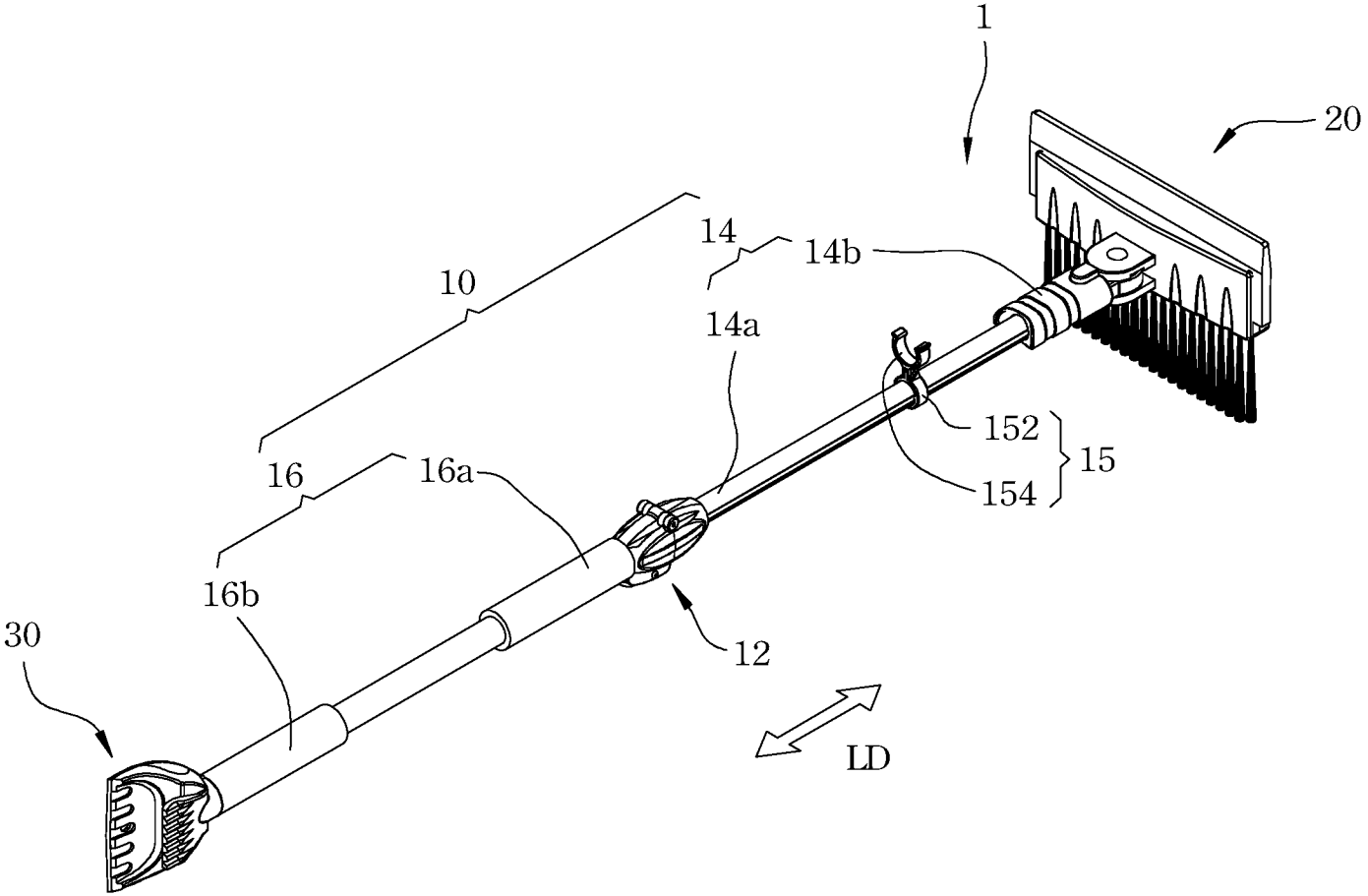
FIG. 1 is a perspective view of the cleaning tool of an embodiment according to the present invention.
Figure 2:
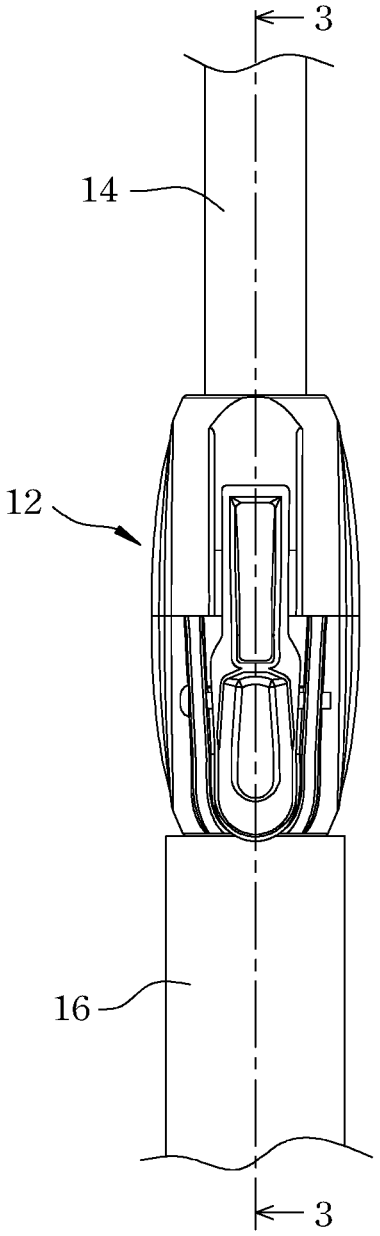
FIG. 2 is a partial top view of the cleaning tool of the embodiment according to the present invention, showing the fixing structure of the cleaning tool.

As illustrated in FIG. 1, a cleaning tool 1 of an embodiment according to the present invention includes a holding rod 10 and a first tool assembly 20.

The holding rod 10 includes a fixing structure 12, a first rod body 14, and a second rod body 16, wherein the first end 14*a* of the first rod body 14 is pivotally connected to a first end 16*a* of the second rod body 16. The fixing structure 12 is disposed on either the first rod body 14 or the second rod body 16. The first tool assembly 20 is connected to a second end 14*b* of the first rod body 14, wherein the second end 14*b* of the first rod body 14 is opposite to the first end 14*a* of the first rod body 14.

Referring to FIG. 1, the cleaning tool 1 includes a second tool assembly 30; the second tool assembly 30 is connected to a second end 16*b* of the second rod body 16 of the holding rod 10, wherein the second end 16*b* of the second rod body 16 is opposite to the first end 16*a* of the second rod body 16.

As illustrated in FIG. 2 to FIG. 5, the fixing structure 12 has an engaging portion 122, and the other one of the first rod body 14 and the second rod body 16, which is not disposed with the fixing structure 12, has an engaged portion 124, wherein the engaging portion 122 is detachably engaged with the engaged portion 124 correspondingly. In the current embodiment, the fixing structure 12 is fixed to the second rod body 16, and the first rod body 14 has the engaged portion 124.

When the engaging portion 122 is engaged with the engaged portion 124, the first end 14*a* of the first rod body 14 is correspondingly connected to the first end 16*a* of the second rod body 16, thereby the holding rod 10 has a maximum length. When the engaging portion 122 is disengaged from the engaged portion 124, the first rod body 14 and the second rod body 16 is controllably folded to each other.

The fixing structure 12 includes a first pressed portion 121, the engaging portion 122, a first resisting portion 123, and a fulcrum 125, wherein the first pressed portion 121 and the first resisting portion 123 face opposite directions and are located on a side of the fulcrum 125; the engaging portion 122 is located on another side of the fulcrum 125 opposite to the side of the first pressed portion 121 and the first resisting portion 123.

Figure 3:
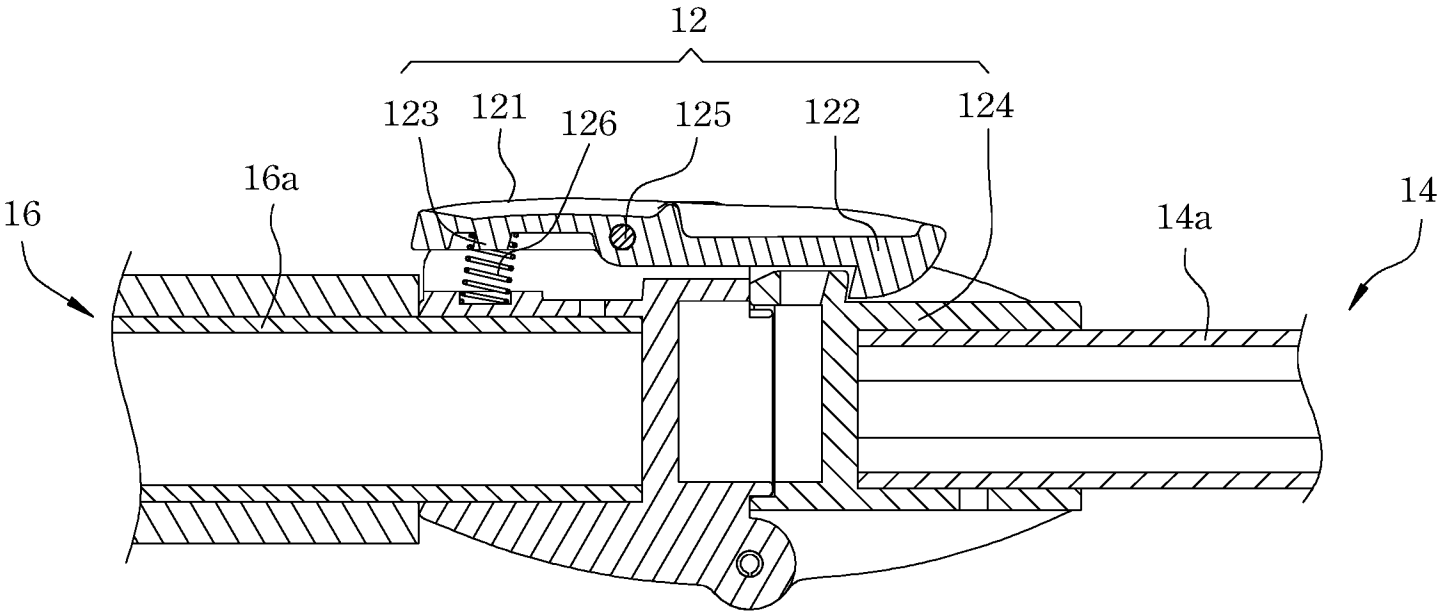
FIG. 3 is a sectional view taken along the 3-3 line in FIG. 2.

The first resisting portion 123 is connected to a first elastic member 126. When the engaging portion 122 is correspondingly engaged with the engaged portion 124, the first resisting portion 123 is resisted by the first elastic member 126 to make the engaging portion 122 abut against the engaged portion 124, so that the first end 14*a* of the first rod body 14 is correspondingly connected to the first end 16*a* of the second rod body 16, thereby the holding rod 10 has the maximum length, as shown in FIG. 3.

Figure 4:
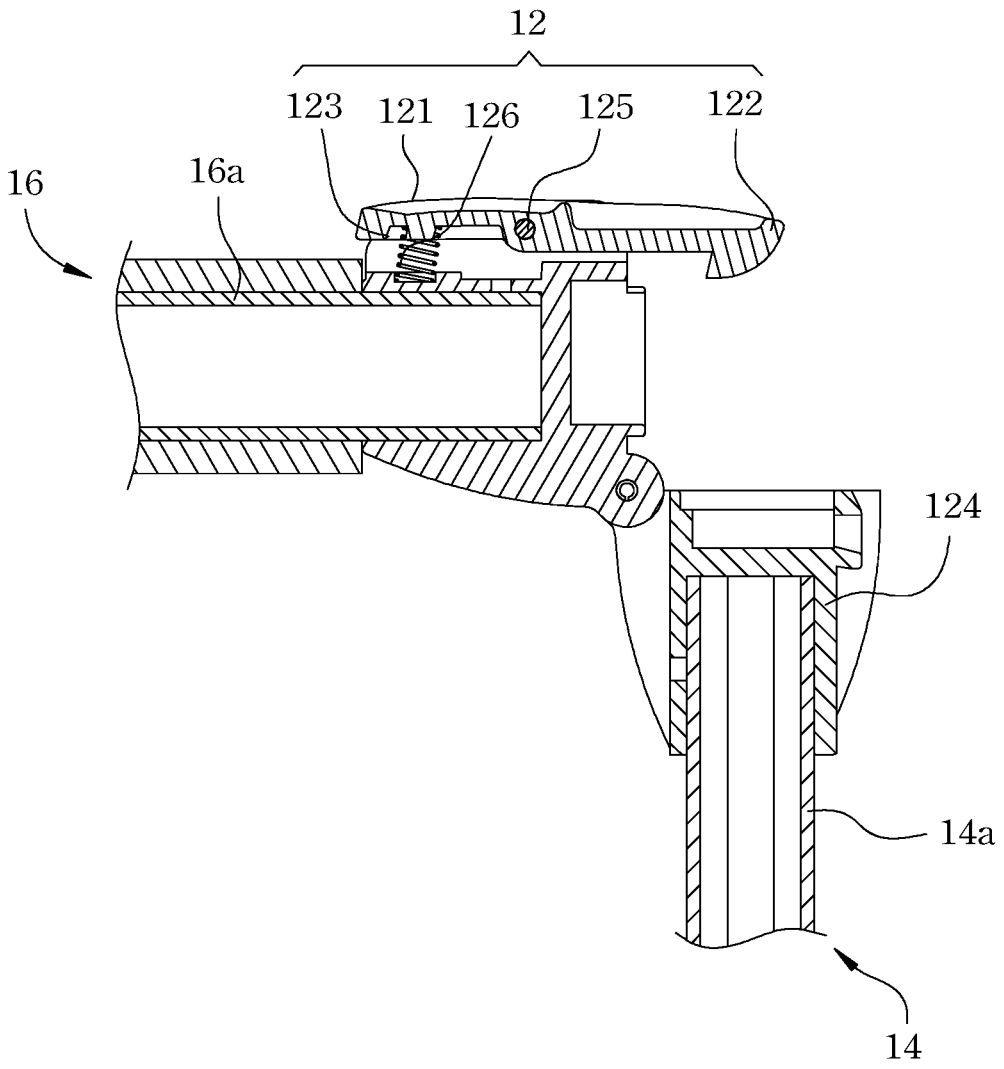
FIG. 4 is another sectional view of the holding rod of the cleaning tool of the embodiment according to the present invention, showing the fixing structure is unlocked and the holding rod is folded.

Referring to FIG. 4, when the first pressed portion 121 is pressed by an external force, the engaging portion 122 is moved in a direction away from the engaged portion 124 to be disengaged from the engaged portion 124, thereby to make the first rod body 14 and the second rod body 16 be folded to each other.

Figure 5:
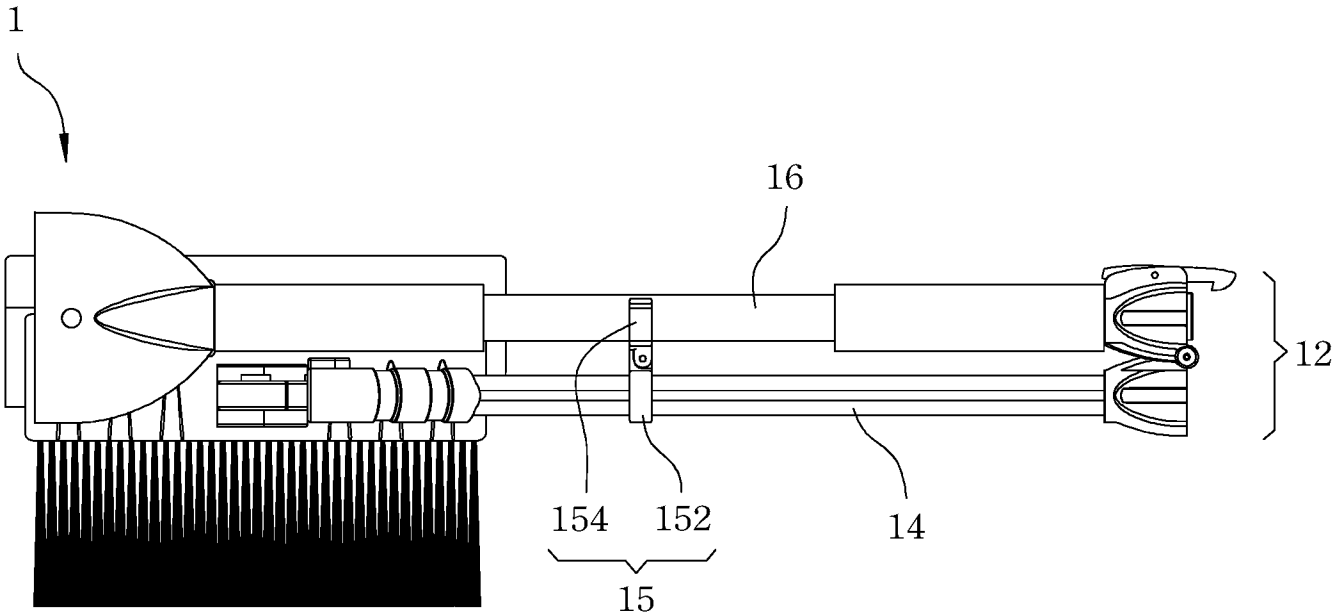
FIG. 5 is a top view of the cleaning tool of the embodiment according to the present invention, showing the holding rod completely folded.

Referring to FIG. 5, the first rod body 14 and the second rod body 16 are folded to each other and are substantially parallel to each other. In the current embodiment, the holding rod 10 includes a binding member 15, wherein the binding member 15 is disposed on either the first rod body 14 or the second rod body 16.

When the first rod body 14 and the second rod body 16 are folded to each other and are substantially parallel to each other, the other one of the first rod body 14 and the second rod body 16, which isn't disposed with the binding member 15, is detachably connected to the binding member 15. As shown in FIG. 1 to FIG. 5, the binding member 15 includes a fixing ring 152 and a C-shaped loop 154, wherein the fixing ring 152 is connected to the C-shaped loop 154 to be adjacent to the C-shaped loop 154 and is disposed on either the first rod body 14 or the second rod body 16. When the first rod body 14 and the second rod body 16 are folded to each other and are substantially parallel to each other, the other one of the first rod body 14 and the second rod body 16, which isn't disposed with the binding member 15, is detachably connected to the C-shaped loop 154. In the current embodiment, the fixing ring 152 is disposed to the first rod body 14, so that when the first rod body 14 and the second rod body 16 are folded to be substantially parallel to each other, the second rod body 14 is detachably connected to the C-shaped loop 154.

In the current embodiment, the C-shaped loop 154 is pivotally connected to the fixing ring 152 and is able to pivot relative to the fixing ring 152, wherein the C-shaped loop 154 has two planes which face opposite directions. When the first end 14*a* of the first rod body 14 is connected to the first end 16*a* of the second rod body 16, the C-shaped loop 154 is controllably folded relative to the fixing ring 152 to make the planes of the C-shaped loop 154 are parallel to a longitudinal direction LD of the first rod body 14, thereby to prevent a user or surrounding objects from being impeded by the C-shaped loop 154 of the binding member 15 while the user is using the cleaning tool 1. When the first rod body 14 and the second rod body 16 are folded to each other and are substantially parallel to each other, the C-shaped loop 154 which is folded could be controllably pulled up to make the planes of the C-shaped loop 154 are substantially perpendicular to the longitudinal direction LD of the first rod body 14, thereby to detachably connect the second rod body 14 to the C-shaped loop 154.

Figure 6:
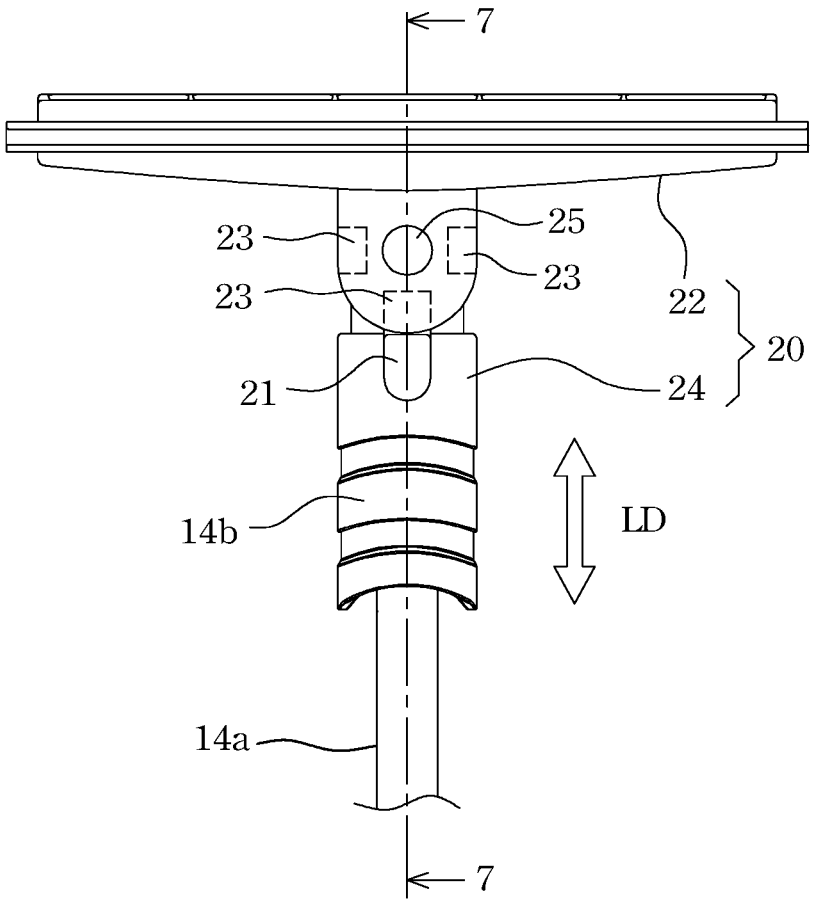
FIG. 6 is a partial top view of the cleaning tool of the embodiment according to the present invention, showing the first tool assembly of the cleaning tool.
Figure 7:
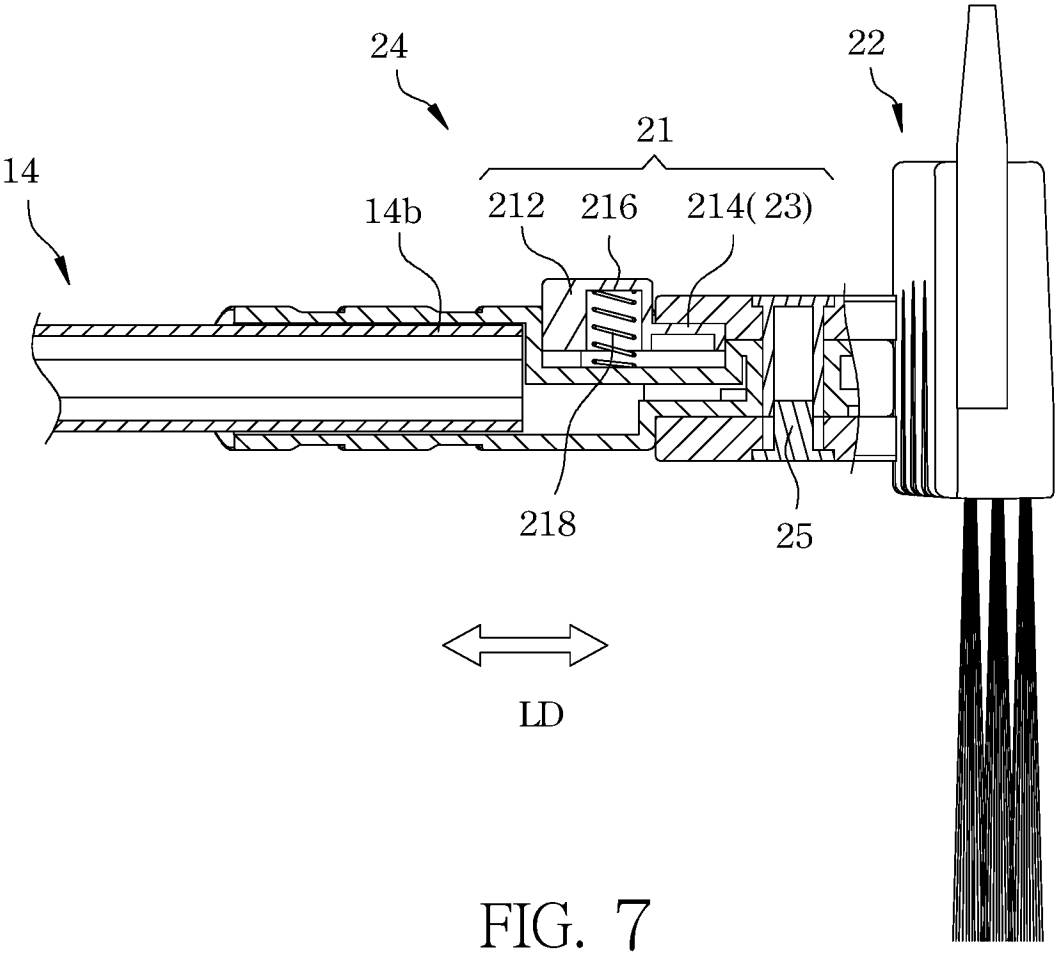
FIG. 7 is a sectional view taken along the 7-7 line in FIG. 6.

As illustrated in FIG. 6 and FIG. 7, the first tool assembly 20 includes a pivotable member 22 and a fixing member 24, wherein the pivotable member 22 is pivotally connected to the fixing member 24 which is fixed to the second end 14*b* of the first rod body 14 of the holding rod 10.

Either the pivotable member 22 or the fixing member 24 includes a positioning flange 21, and the other one includes at least one positioning recess 23. In the current embodiment, the fixing member 24 includes the positioning flange 21 and the pivotable member 22 includes the at least one positioning recess 23. When the positioning flange 21 corresponds to the at least one positioning recess 23, the positioning flange 21 is engaged with the at least one positioning recess 23, thereby to prevent the pivotable member 22 from pivoting relative to the fixing member 24.

The positioning flange 21 includes a second pressed portion 212, an abutting portion 214, and a second resisting portion 216, wherein the second pressed portion 212 and the abutting portion 214 are located on a side of the positioning flange 21, and the second resisting portion 216 is located on another side positioning flange 21 opposite to the second pressed portion 212 and the abutting portion 214. The second resisting portion 216 is connected to a second elastic member 218. When the positioning flange 21 is engaged with the at least one positioning recess 23, the positioning flange 21 is resisted by the second elastic member 218 to make the abutting portion 214 abut against the at least one positioning recess 23. On contrary, when the second pressed portion 212 is pressed by an external force, the positioning flange 21 is moved in a direction toward the second elastic member 218, thereby the abutting portion 214 is disengaged from the at least one positioning recess 23, allowing the pivotable member 22 to freely pivot relative to the fixing member 24.

The first tool assembly 20 includes a pivotal axis 25, and the pivotable member 22 is connected to the fixing member 24 via the pivotal axis 25. In the current embodiment, the at least one positioning recess 23 includes, but not limited to, three recessing portions 23 and is arranged around the pivotal axis 25. When the pivotable member 22 pivots relative to the fixing member 24 to make the positioning flange 21 corresponds to one of the three positioning recesses 23, the positioning flange 21 is engaged with the corresponding positioning recess 23. Referring to FIG. 6, the fixing member 24 has the positioning flange 21, and the pivotable member 22 includes three positioning recesses 23, wherein when the positioning flange 21 is correspondingly engaged with the positioning recess 23 in a middle position, the first tool assembly 20 is in a working state, and a longitudinal direction of the first tool assembly 20 is perpendicular to the longitudinal direction LD of the holding rod 10, as shown in FIG. 1. In another embodiment, when the positioning flange 21 could correspondingly engaged with one of the positioning recesses 23 in right and left position, the first tool assembly 20 is in a storing state, and the longitudinal direction of the first tool assembly 20 is parallel to the longitudinal direction LD of the holding rod 10, as shown in FIG. 5. In the current embodiment, an axial direction of the pivotal axis 25 is perpendicular to the longitudinal direction LD of the holding rod 10.

With the holding rod which is straightenable and foldable, the volume of the cleaning tool of the embodiment according to the present invention could be decreased, so that the cleaning tool could be conveniently stored, carried, and transported. On the other side, the rod body is not easily bent or broken due to a crush during storage or transportation.

It must be pointed out that the embodiment described above is only a preferred embodiment of the present invention. All equivalent structures which employ the concepts disclosed in this specification and the appended claims should fall within the scope of the present invention.

What is claimed is:

1. A cleaning tool, comprising:

a holding rod comprising a fixing structure, a first rod body, and a second rod body, wherein a first end of the first rod body is pivotally connected to a first end of the second rod body; the fixing structure is disposed on either the first rod body or the second rod body and has an engaging portion, and the other one of the first rod body or the second rod body has an engaged portion; the engaging portion is detachably engaged with the engaged portion correspondingly; when the engaging portion is engaged with the engaged portion, the first end of the first rod body is correspondingly connected to the first end of the second rod body, thereby the holding rod has a maximum length; when the engaging portion is disengaged from the engaged portion, the first rod body and the second rod body is controllably folded to each other; and a first tool assembly connected to a second end of the first rod body, wherein the second end of the first rod body is opposite to the first end of the first rod body;

wherein the fixing structure comprises a first pressed portion, the engaging portion, a first resisting portion, and a fulcrum; the first pressed portion and the first resisting portion face opposite directions and are located on a side of the fulcrum, and the engaging portion is located on another side of the fulcrum opposite to the side with the first pressed portion and the first resisting portion; the first resisting portion is connected to a first elastic member; when the engaging portion is correspondingly engaged with the engaged portion, the first resisting portion is resisted by the first elastic member to make the engaging portion abut against the engaged portion, so that the first end of the first rod body is correspondingly connected to the first end of the second rod body, thereby the holding rod has the maximum length; when the first pressed portion is pressed by an external force, the engaging portion is moved in a direction away from the engaged portion to be disengaged from the engaged portion, thereby to make the first rod body and the second rod body be folded to each other;

wherein when the engaging portion of the fixing structure is disengaged from the engaged portion, the first rod is pivotally rotatable along a pivotal axis relative to the second rod, and the pivotal axis is perpendicular to a longitudinal direction of the holding rod.

2. The cleaning tool of claim 1, wherein the holding rod comprises a binding member which is disposed on either the first rod body or the second rod body; when the first rod body and the second rod body are folded to be substantially parallel to each other, the other one of the first rod body and the second rod body, which isn't disposed with the binding member, is detachably connected to the binding member.

3. The cleaning tool of claim 2, wherein the binding member comprises a fixing ring and a C-shaped loop; the fixing ring is connected to the C-shaped loop and is disposed on either the first rod body or the second rod body; when the first rod body and the second rod body are folded to each other to be substantially parallel to each other, the other one of the first rod body and the second rod body, which isn't disposed with the binding member, is detachably connected to the C-shaped loop.

4. The cleaning tool of claim 3, wherein the C-shaped loop is pivotally connected to the fixing ring and is able to pivot relative to the fixing ring.

5. The cleaning tool of claim 1, wherein the first tool assembly comprises a pivotable member and a fixing member; the pivotable member is pivotally connected to the fixing member which is fixed to the second end of the first rod body of the holding rod.

6. The cleaning tool of claim 5, wherein either the pivotable member or the fixing member comprises a positioning flange, and the other one comprises at least one positioning recess; when the positioning flange corresponds to the at least one positioning recess, the positioning flange is engaged with the at least one positioning recess, so that the pivotable member is unable to pivot relative to the fixing member.

7. The cleaning tool of claim 6, wherein the positioning flange comprises a second pressed portion, an abutting portion, and a second resisting portion; the second pressed portion and the abutting portion are located on a side of the positioning flange, and the second resisting portion is located on another side of the positioning flange opposite to the side with the second pressed portion and the abutting portion; the second resisting portion is connected to a second elastic member; when the positioning flange is correspondingly engaged with the at least one positioning recess, the positioning flange is resisted by the second elastic member to make the abutting portion abut against the at least one positioning recess; when the second pressed portion is pressed by an external force, the positioning flange is moved in a direction toward the second elastic member, thereby the abutting portion is disengaged from the at least one positioning recess, allowing the pivotable member to freely pivot relative to the fixing member; wherein the second pressed portion, the abutting portion, and the second resisting portion are located at a monolithic component; when the second pressed portion is pressed, the abutting portion is moved simultaneously.

8. The cleaning tool of claim 7, wherein the first tool assembly comprises a pivotal axis, and the pivotable member is connected to the fixing member via the pivotal axis; the at least one positioning recess comprises a plurality of positioning recesses arranged around the pivotal axis; when the pivotable member pivots relative to the fixing member to make the positioning flange corresponds to an one of the plurality positioning recesses, the positioning flange is engaged with the corresponding positioning recess.

9. The cleaning tool of claim 8, wherein an axial direction of the pivotal axis is perpendicular to the longitudinal direction of the holding rod.

10. The cleaning tool of claim 1, further comprising a second tool assembly connected to a second end of the second rod body of the holding rod, wherein the second end of the second rod body is opposite to the first end of the second rod body.

* * * * *